US007571899B2

(12) United States Patent
Kitasako et al.

(10) Patent No.: US 7,571,899 B2
(45) Date of Patent: Aug. 11, 2009

(54) GAS-LIQUID DISSOLVING APPARATUS

(75) Inventors: Hiroshi Kitasako, Shimane (JP); Masao Katsube, Shimane (JP); Katsuhiro Sakamoto, Shimane (JP); Junzo Sago, Ibaraki (JP); Hiroaki Tanaka, Ibaraki (JP); Jun Tsumori, Ibaraki (JP)

(73) Assignees: Matsuedoken Co., Ltd., Shimane (JP); Incorporated Administrative Agency Public Works Research Institute, Ibaraki (JP)

( * ) Notice: Subject to any disclaimer, the term of this patent is extended or adjusted under 35 U.S.C. 154(b) by 537 days.

(21) Appl. No.: 10/597,627

(22) PCT Filed: Jan. 28, 2005

(86) PCT No.: PCT/JP2005/001268

§ 371 (c)(1),
(2), (4) Date: Aug. 1, 2006

(87) PCT Pub. No.: WO2005/075365

PCT Pub. Date: Aug. 18, 2005

(65) Prior Publication Data

US 2008/0142424 A1 Jun. 19, 2008

(51) Int. Cl.
*B01F 3/04* (2006.01)

(52) U.S. Cl. ..... 261/29; 210/220; 261/36.1; 261/78.2; 261/123

(58) Field of Classification Search ..... 261/29, 261/36.1, 77, 78.2, 120, 123, DIG. 75; 210/220, 210/221.1, 221.2
See application file for complete search history.

(56) References Cited

U.S. PATENT DOCUMENTS

| | | | | | |
|---|---|---|---|---|---|
| 2,094,778 | A | * | 10/1937 | Alexander | 261/123 |
| 2,790,506 | A | * | 4/1957 | Van Vactor | 96/334 |
| 3,271,304 | A | * | 9/1966 | Valdespino et al. | 210/621 |
| 3,464,189 | A | * | 9/1969 | Mergenthaler | 96/349 |
| 3,671,022 | A | * | 6/1972 | Laird et al. | 261/29 |
| 3,722,679 | A | * | 3/1973 | Logue | 209/164 |
| 4,107,240 | A | * | 8/1978 | Verner et al. | 261/77 |
| 4,112,026 | A | * | 9/1978 | Kumazawa | 261/29 |
| 4,162,971 | A | * | 7/1979 | Zlokarnik et al. | 210/620 |
| 4,211,733 | A | * | 7/1980 | Chang | 261/36.1 |
| 4,436,675 | A | * | 3/1984 | Hisao et al. | 261/77 |
| 4,534,862 | A | * | 8/1985 | Zlokarnik | 210/221.2 |

(Continued)

FOREIGN PATENT DOCUMENTS

| | | | | | |
|---|---|---|---|---|---|
| JP | 53-16963 | A | * | 2/1978 | 261/77 |

(Continued)

*Primary Examiner*—Richard L Chiesa
(74) *Attorney, Agent, or Firm*—Lowe Hauptman Ham & Berner, LLP

(57) ABSTRACT

A gas-liquid dissolving apparatus includes an intake unit that takes in to-be-treated water from an oxygen-deficient water area, an oxygen-containing gas supply unit, a bottomed gas-liquid dissolving chamber that has at least one hole formed in a lower portion and a top plate provided in an upper portion, a nozzle that ejects the gas supplied by the supplying unit and the water supplied by the intake unit, a gas-liquid separating chamber that has a gas-vent hole formed in an upper portion and a takeout port provided in a lower portion thereof, and a water supplying unit that returns the water taken out from the takeout port to the oxygen-deficient water area.

15 Claims, 8 Drawing Sheets

U.S. PATENT DOCUMENTS

| | | | | | |
|---|---|---|---|---|---|
| 4,556,523 | A | * | 12/1985 | Lecoffre et al. | 261/123 |
| 4,707,308 | A | * | 11/1987 | Ryall | 261/77 |
| 4,789,503 | A | * | 12/1988 | Murphy | 261/77 |
| 5,304,356 | A | * | 4/1994 | Iijima et al. | 422/226 |
| 5,605,653 | A | * | 2/1997 | DeVos | 261/77 |
| 5,783,118 | A | * | 7/1998 | Kolaini | 261/37 |
| 6,394,428 | B2 | * | 5/2002 | Hinada et al. | 261/77 |
| 2002/0117765 | A1 | * | 8/2002 | Hinada et al. | 261/77 |

FOREIGN PATENT DOCUMENTS

| | | | | | |
|---|---|---|---|---|---|
| JP | 62-213897 | A | * | 9/1987 | 210/220 |
| JP | 5-168981 | A | | 7/1993 | |
| JP | 7-185281 | A | | 7/1995 | |
| JP | 11-207162 | A | | 8/1999 | |
| JP | 2000-245295 | A | | 9/2000 | |
| JP | 2002-177953 | A | | 6/2002 | |
| JP | 2002-200415 | A | | 7/2002 | |
| JP | 2002-273183 | A | | 9/2002 | |
| JP | 2002-346351 | A | | 12/2002 | |
| JP | 2003-53168 | A | | 2/2003 | |
| JP | 2003-340251 | A | | 12/2003 | |

* cited by examiner

GAS-LIQUID DISSOLVING APPARATUS

RELATED APPLICATIONS

The present application is a National Phase application based on International Application Number PCT/JP2005/001268, filed Jan. 28, 2005, which claims priority from, Japanese Patent Application No. 2004-027318, filed Feb. 3, 2004, the disclosures of which is hereby incorporated by reference herein in its entirety.

TECHNICAL FIELD

The present invention relates to a gas-liquid dissolving apparatus that continuously generates liquid into which a gas component is dissolved in high concentrations. More particularly, the present invention relates to a gas-liquid dissolving apparatus that dissolves an oxygen-containing gas into water taken in from an oxygen-deficient water area to increase a dissolved oxygen concentration of the water, and that returns the water to the water area.

BACKGROUND ART

On a bottom layer of a lake or a marsh, a dam, a river, an inner bay, or the like, organic matters resulting from domestic wastewater or agricultural wastewater flowing in from the ground or remains of aquatic plants and planktons that multiply using the organic matters as a nutrition source, are deposited. These organic matters and deposits are decomposed while consuming oxygen contained in bottom layer water. As a result of this decomposition reaction accompanying the oxygen consumption, an oxygen-deficient water area is generated on the bottom layer of the lake or the marsh or the like.

The oxygen-deficient water area refers to an area having a dissolved oxygen concentration as low as 1 to 2 mg/liter, which concentration is far lower than the dissolved oxygen concentration of 10 mg/liter near the surface of the water. The oxygen-deficient water area, in particular, is caught up in a vicious circle. That is, the oxygen-deficient water area is often contaminated, so that photosynthesis cannot take place and algae do not grow, accordingly. Since no algae grow, oxygen is not generated, whereby oxygen deficiency is exacerbated.

It is known that the oxygen deficiency of the bottom layer has various adverse effects on environments of lakes and marshes and the like. For example, if the bottom layer is in an oxygen-deficient state, benthoses often become extinct. If the bottom layer becomes oxygen-deficient, then a reducing atmosphere is established, and metals are eluted from surrounding rocks and stones and from bottom sludge, often resulting in water pollution.

To eliminate such an oxygen-deficient state, there are conventionally known methods for supplying oxygen to the oxygen-deficient water area and increasing the dissolved oxygen concentration. A method for directly supplying bubbled oxygen or the air to the oxygen-deficient water area is disclosed in, for example, Japanese Patent Application Laid-Open No. H5-168981 entitled "oxygen blowing apparatus", Japanese Patent Application Laid-Open No. H7-185281 entitled "gas dissolving apparatus", and Japanese Patent Application Laid-Open No. 2002-200415 entitled "apparatus for dissolving air into water".

A method for forcedly dissolving oxygen into water by pressurizing and mixing up the oxygen and the water in a sealed tank, producing water having an increased dissolved oxygen concentration (hereinafter, referred to as "high dissolved oxygen concentration water" as appropriate), and supplying the high dissolved oxygen concentration water to the oxygen-deficient water area is disclosed in Japanese Patent Application Laid-Open No. 2002-177953 entitled "an automatic dissolved oxygen control method for underwater installation type pressurized tank water", and Japanese Patent Application Laid-Open No. 2000-245295 entitled "apparatus for supplying oxygen-rich water".

A method for generating high dissolved oxygen concentration water in a similarly sealed tank, temporarily releasing the generated water into the air in the tank, and supplying the high dissolved oxygen concentration water to the oxygen-deficient water area is disclosed in Japanese Patent Application Laid-Open No. H11-207162 entitled "pressurization type oxygen dissolving method". A method for filling a to-be-dissolved gas into a sealed tank, ejecting water into the tank, and dissolving the gas into the water is disclosed in Japanese Patent Application Laid-Open No. 2002-346351 entitled "gas dissolving apparatus".

Patent Document 1: Japanese Patent Application Laid-Open No. H5-168981 Patent Document 2: Japanese Patent Application Laid-Open No. H7-185281 Patent Document 3: Japanese Patent Application Laid-Open No. 2002-200415 Patent Document 4: Japanese Patent Application Laid-Open No. 2002-177953 Patent Document 5: Japanese Patent Application Laid-Open No. 2000-245295 Patent Document 6: Japanese Patent Application Laid-Open No. H1-207162 Patent Document 7: Japanese Patent Application Laid-Open No. 2002-346351

DISCLOSURE OF THE INVENTION

Problems to be Solved by the Invention

The conventional techniques have, however, the following problems.

With the techniques disclosed in the Japanese Patent Application Laid-Open Nos. H5-168981, H7-185281, and 2002-200415, if the bubbled oxygen or the air is directly supplied to the oxygen-deficient water area, most of the bubbled oxygen or the air rises up to the water surface. An efficient improvement in oxygen concentration cannot be, therefore, attained.

Since the bubbles per se that rise up to the water surface produce a water stream that curls up bottom materials, the following problems often arise. If the bottom materials are curled up, deposited organic matters and the like are agitated to accelerate the decomposition reaction. This, in turn, often reduces the oxygen concentration and expands the oxygen-deficient water area. When the bottom materials are curled up, metal components eluted from the surrounding rocks and stones and the bottom sludge are diffused, which sometimes worsens the water pollution.

With the techniques disclosed in the Japanese Patent Application Laid-Open Nos. 2002-177953 and 2000-245295, if the high dissolved oxygen concentration water having a high pressure is supplied to the oxygen-deficient water area, oxygen is deposited as bubbles due to a pressure reduction. Then, similarly to the above, the problems accompanying the curling-up of the bottom materials arise. With the technique disclosed in the Japanese Patent Application Laid-Open No. H11-207162, bubbles are produced and mixed in the high dissolved oxygen concentration water supplied from the tank when the water is temporarily released into the air. The problems that the bottom materials are curled up arises, similarly.

Furthermore, to produce the high dissolved oxygen concentration water in the sealed tank, equipment for controlling an internal pressure and a water level of the tank is necessary.

This disadvantageously makes the entire apparatus larger in scale, thereby increasing an equipment cost.

If a large volume of water such as that on the bottom of the lake or in the dam is treated, it is generally desired to perform a continuous water treatment. For such a treatment, it is also desirable to take out only a liquid part that does not contain the bubbles in view of pump driving and the avoidance of curling up of the bottom materials as described above.

It is also desired to continuously supply the generated high dissolved oxygen concentration water by a fixed amount, that is, to stably supply the water for the following reason. If the water changes in amount, the water stream fluctuates, causing the curling up of the bottom materials.

The present invention has been achieved to solve the conventional problems. An object of the present invention is to provide a gas-liquid dissolving apparatus that can efficiently increase an oxygen concentration of an oxygen-deficient water area while preventing bottom materials from curling up by bubbles, and that can be configured at a low cost.

Another object of the present invention is to provide a gas-liquid dissolving apparatus that can stably and continuously supply liquid into which a high concentration gas component is dissolved and which does not contain bubbles.

Means to Solve the Problems

To achieve the objects as described above, a gas-liquid dissolving apparatus dissolves an oxygen-containing gas into water taken in from an oxygen-deficient water area, increases a dissolved oxygen concentration of the water, and returns the increased dissolved oxygen concentration water to the oxygen-deficient water area, and the apparatus includes an intake unit that takes in to-be-treated water from the oxygen-deficient water area, a supplying unit that supplies the oxygen-containing gas, a bottomed gas-liquid dissolving chamber that has at least one hole formed in a lower portion and that has a top plate provided in an upper portion, a nozzle that ejects the gas supplied by the supplying unit and the water supplied by the intake unit upward so that the gas and the water strike against an inner wall of the top plate, that fills the gas-liquid dissolving chamber with bubbles of the gas and the water, and that vigorously agitates the bubbles and the water by forces of the ejected gas and water, a gas-liquid separating chamber that is provided outside the gas-liquid dissolving chamber while communicating with the gas-liquid dissolving chamber through the holes, that separates the bubbles and the water flowing out from the gas-liquid dissolving chamber through the holes from each other while storing the bubbles and the water, that has a gas-vent hole formed in an upper portion of the gas-liquid separating chamber for releasing the separated bubbles to an outside, and that has a takeout port provided in a lower portion thereof for taking out the water separated from the bubbles, and a water supplying unit that returns the water taken out from the takeout port to the oxygen-deficient water area.

Thus, the invention generates the high dissolved oxygen concentration water as follows. The oxygen-containing gas supplied from the supplying unit and the oxygen-deficient water supplied from the intake unit first form a gas-liquid multi-phase fluid in the nozzle. This gas-liquid multi-phase fluid is ejected from the nozzle into the gas-liquid dissolving chamber, strikes against the top plate, scatters, turns around, and descends within the gas-liquid dissolving chamber. At this time, the gas-liquid multi-phase fluid forms an eddy or a turbulent flow by its own ejection force, thereby breaking the bubbles. This eddy or turbulent flow causes the gas and the water contained in the gas-liquid multi-phase fluid to vigorously contact with each other and to be agitated, thereby dissolving the gas (oxygen) into the water. The gas-liquid multi-phase fluid ejected from the nozzle continuously strikes against the gas-liquid multi-phase fluid descending within the gas-liquid dissolving chamber, thereby causing the further contact and agitation between the gas and the water to further dissolve the gas (oxygen) into the water.

Thus, the gas-liquid dissolving apparatus according to the present invention, differently from the gas-liquid dissolving apparatus that forcedly dissolves the gas into the water, increases a contact area and a contact opportunity between the gas and the water by the force of the gas-liquid multi-phase fluid ejected from the nozzle in a superimposed manner, and thus accelerates the dissolution of the gas into the water.

The gas-liquid dissolving apparatus according to the present invention traps a water stream by the wall within the gas-liquid dissolving chamber, thereby preventing larger bubbles from excessively flowing out toward the gas-liquid separating chamber due to the force of the water. Therefore, it is possible to naturally separate fine bubbles from the water within the gas-liquid separating chamber and continuously take out only the high dissolved oxygen concentration water.

The high dissolved oxygen concentration water generated by the gas-liquid dissolving apparatus according to the present invention is not generated by an excessive increase of the internal pressure to a higher level than an atmospheric pressure for a forced dissolution of the gas into the water as in the conventional apparatus. Hence, even if the high dissolved oxygen concentration water is returned to the oxygen-deficient water area, bubbles are not deposited from pressure release. In addition, the sealed reaction container such as a high pressure tank and the equipment for controlling the internal pressure and the water level of the reaction container are unnecessary. Therefore, the apparatus itself can be simplified. The atmospheric pressure means a surrounding pressure at a location at which the main parts (the gas-liquid dissolving chamber, the gas-liquid separating chamber, and the nozzle) of the gas-liquid dissolving apparatus are installed. If the installation location is on the ground, the atmospheric pressure means the air pressure. If the installation location is in water, the atmospheric pressure means the water pressure. Though the pressurization (for example, application of a pressure equal to approximately one atmospheric pressure) for ejecting the water and the gas from the nozzle is required to form the water stream, such a mechanism does not correspond to a pressurization mechanism for providing an excessively high pressure as explained above.

Examples of the water is assumed to include not only water which does not contain salt, such as water in rivers, lakes, marshes, and dams, but also seawater, brackish water, and the like, which contains salt. Furthermore, bottomed is an expression that represents a state that the gas-liquid dissolving chamber is substantially sealed. "The bottomed gas-liquid dissolving chamber that has at least one hole formed in a lower portion and that has a top plate provided in an upper portion" means a state in which the gas-liquid dissolving chamber is closed except for the penetrating parts such as the hole and the nozzle. The top plate is not necessarily provided separately in the gas-liquid dissolving chamber and may be an upper surface of the gas-liquid dissolving chamber (a surface of a part that forms a ceiling). The inner wall of the top plate, therefore, means an inner surface in the upper portion of the gas-liquid dissolving chamber. The takeout port can be paraphrased to a delivery port for delivering the liquid having the increased dissolved gas component concentration to the outside of the apparatus.

Further, in the gas-liquid dissolving apparatus the top plate has a dome shape. Thus, the gas-liquid multi-phase fluid ejected from the nozzle is caused to flow along the dome without stagnation, so that the contact opportunity between the gas and the water can be efficiently increased, the contact area therebetween can be increased, and the dissolution of the gas into the water can be further accelerated. In addition, with the top plate formed in a dome shape, durability of the gas-liquid dissolving chamber can be enhanced.

Still further, in the gas-liquid dissolving apparatus, a tip end of the nozzle is tapered toward an ejection port. Thus, the gas-liquid multi-phase fluid is urged to flow into the gas-liquid dissolving chamber.

Still further, in the gas-liquid dissolving apparatus, the gas-liquid dissolving chamber is accommodated in the gas-liquid separating chamber. Thus, the high dissolved oxygen concentration water is caused to directly flow out from the hole of the gas-liquid dissolving chamber into the gas-liquid separating chamber. This can, therefore, dispense with equipment such as a tube for supplying the high dissolved oxygen concentration water into the gas-liquid separating chamber. Since the apparatus is configured integrally, it is possible to easily install and withdraw the apparatus.

Still further, in the gas-liquid dissolving apparatus, a total sectional area of the hole is set larger than an area of the ejection port of the nozzle. Thus, the gas-liquid multi-phase fluid ejected from the nozzle is prevented from excessively increasing the internal pressure of the gas-liquid dissolving chamber.

Still further, in the gas-liquid dissolving apparatus, at least the intake unit, the gas-liquid dissolving chamber, the nozzle, and the gas-liquid separating chamber are installed in the oxygen-deficient water area. Thus, the water pressure is increased and, therefore, more gas can be dissolved into the water. According to such an installation method, as compared with the installation of the apparatus on the ground, energy necessary to take in and discharge water can be saved.

Still further, in the gas-liquid dissolving apparatus, a side surface of the gas-liquid dissolving chamber is formed to be cylindrical or axially symmetric, and the gas-liquid dissolving chamber is accommodated in the gas-liquid separating chamber, a partition member that has an open upper portion and a side surface of a cylindrical or axially symmetric shape, and that is formed to be tapered toward the upper portion is provided between the gas-liquid dissolving chamber and the gas-liquid separating chamber, the bubbles and the water moving from the gas-liquid dissolving chamber toward the partition member through the hole are caused to flow out at a predetermined angle with respect to a radial direction of the gas-liquid dissolving chamber, and a circulating stream that moves upward is generated between an outside of the gas-liquid dissolving chamber and an inside of the partition member.

Thus, lower specific gravity bubbles are collected at the center by the circulating stream, a velocity of which is higher toward the upper portion, and the bubbles can be efficiently and effectively separated from the water. Since the apparatus is configured integrally, the apparatus can be easily installed and withdrawn. When "a side surface of the gas-liquid dissolving chamber" is described to be "formed to be cylindrical or axially symmetric," the gas-liquid dissolving chamber is assumed to have the hemispherical upper portion and the columnar side surface, for example, and an external shape of the cross-section of the gas-liquid dissolving chamber perpendicular to an axis thereof may be a circle and a diameter may change along the axis. Likewise, when "a partition member" is described to have "a side surface of a cylindrical or axially symmetric shape," and "to be tapered toward the upper portion," the partition member is assumed to be a truncated hollow circular cone, a combination of hollow circular cylinders having a common axis and different diameters, or a member obtained by connecting hollow circular cylinders having a common axis and different diameters using a hollow circular cone.

Still further, in the gas-liquid dissolving apparatus a formation direction of the hole is set to a direction at the predetermined angle by a thickness of the gas-liquid dissolving chamber. Thus, the configuration of the apparatus is simplified to allow for the reduction of factors for fault parts and a long-term continuous use of the apparatus.

Still further, a gas-liquid dissolving apparatus includes a supplying unit that supplies a gas-liquid multi-phase fluid in which a liquid and a gas are mixed up, a gas-liquid dissolving chamber that receives a flow of the gas-liquid multi-phase fluid in an upper portion and that has a relief hole formed in a lower portion for releasing fluid, a nozzle that penetrates the gas-liquid dissolving chamber and that ejects the gas-liquid multi-phase fluid supplied by the supplying unit upward toward the upper portion of the gas-liquid dissolving chamber, a gas-liquid separating chamber that is provided outside the gas-liquid dissolving chamber while communicating with the gas-liquid dissolving chamber through the relief hole, that stores the gas-liquid multi-phase fluid from the relief hole, and that separates the liquid from the gas; and a takeout port from which the liquid separated in the gas-liquid separating chamber is taken out, and a dissolved gas component concentration of the liquid is increased by agitation caused by a force of ejection from the nozzle and a reflux from the upper portion of the gas-liquid dissolving chamber.

Thus, the contact area and the contact opportunity between the liquid and the gas can be increased by the force of the gas-liquid multi-phase fluid ejected from the nozzle in a superimposed manner, to accelerate dissolution of the gas into the water. In addition, the gas is separated from the liquid in the gas-liquid dissolving chamber and the gas-liquid separating chamber by stages, to stably and continuously take out only the liquid part.

The "upper portion" and the "lower portion" mean an upper side and a lower side vertical to the gas-liquid dissolving chamber when the apparatus is installed, respectively. The "relief hole" means a hole that causes the gas-liquid multi-phase fluid to flow out to the outside of the gas-liquid dissolving chamber. The configuration of the supplying unit is not specifically limited as long as the supplying unit can supply the gas-liquid multi-phase fluid to the nozzle. For example, the supplying unit may be configured so that a liquid supplying unit and a gas supplying unit are directly connected to the nozzle. While the gas is collected in the upper portion of the gas-liquid separating chamber, a gas-vent hole or a gas collecting unit may be provided when necessary.

As explained below, the invention may adopt configurations of the respective constituent elements wherein the upper portion may be dome-shaped, and the tip end of the nozzle may be tapered. The manner of providing the gas-liquid separating chamber outside the gas-liquid dissolving chamber may be such that the gas-liquid dissolving chamber is provided separately from the gas-liquid separating chamber or such that the gas-liquid dissolving chamber is accommodated in the gas-liquid separating chamber.

Still further, in the gas-liquid dissolving apparatus, the upper portion of the gas-liquid dissolving chamber has a dome shape. Thus, the gas-liquid multi-phase fluid ejected from the nozzle is caused to flow along the dome without stagnation, so that the contact opportunity between the gas and the water can be efficiently increased, the contact area therebetween can be increased, and the dissolution of the gas into the water can be further accelerated. In addition, with the top portion of the gas-liquid dissolving chamber formed in a dome shape, durability of the gas-liquid dissolving chamber can be enhanced.

Still further, in the gas-liquid dissolving apparatus, a tip end of the nozzle is tapered toward an ejection port. Thus, the gas-liquid multi-phase fluid is urged to flow into the gas-liquid dissolving chamber.

Still further, in the gas-liquid dissolving apparatus, the gas-liquid dissolving chamber is accommodated in the gas-liquid separating chamber. Thus, the gas-liquid multi-phase fluid with an increased dissolved gas component concentration directly flows out from the relief hole of the gas-liquid dissolving chamber into the gas-liquid separating chamber. This can, therefore, dispense with equipment such as a tube for supplying the gas-liquid multi-phase fluid into the gas-liquid separating chamber. Since the apparatus is configured integrally, it is possible to easily install and withdraw the apparatus.

Still further, in the gas-liquid dissolving apparatus, a total sectional area of the relief hole is set larger than an area of the ejection port of the nozzle. Thus, the gas-liquid multi-phase fluid ejected from the nozzle prevents an excessive rise in the internal pressure of the gas-liquid dissolving chamber.

Still further, in the gas-liquid dissolving apparatus, a side surface of the gas-liquid dissolving chamber is formed to be cylindrical or axially symmetric, and the gas-liquid dissolving chamber is accommodated in the gas-liquid separating chamber, a partition member that has an open upper portion and a side surface of a cylindrical or axially symmetric shape, and that is formed to be tapered toward the upper portion is provided between the gas-liquid dissolving chamber and the gas-liquid separating chamber, the gas-liquid multi-phase fluid moving from the gas-liquid dissolving chamber toward the partition member through the relief hole is caused to flow out at a predetermined angle with respect to a radial direction of the gas-liquid dissolving chamber, and a circulating stream that moves upward is generated between an outside of the gas-liquid dissolving chamber and an inside of the partition member. Thus, lower specific gravity gas is collected at the center by the circulating stream, a velocity of which is higher toward the upper portion, and the gas is efficiently separated from the water. Since the apparatus is configured integrally, the apparatus can be easily installed and withdrawn.

Still further, in the gas-liquid dissolving apparatus, a formation direction of the hole is set to a direction at a predetermined angle with respect to a radial direction of the gas-liquid dissolving chamber by a thickness of the gas-liquid dissolving chamber. Thus, the configuration of the apparatus is simplified to allow for the reduction of factors for fault parts and a long-term continuous use of the apparatus.

According to the present invention, a size of the hole (relief hole) of the gas-liquid dissolving chamber is preferably set not to be extremely large so as to prevent large bubbles or eddy current from flowing out into the gas-liquid separating chamber and not to be extremely small so as to prevent a jet flow urged by the hole from flowing out into the gas-liquid separating chamber. In other words, the size of the hole is preferably set to a size which can prevent the water stream in the gas-liquid separating chamber from breaking bubbles and generating fine bubbles. A plurality of holes (relief holes) are further preferably provided so as not to set the size of the hole (relief hole) extremely large. By doing so, a strong water stream can be trapped in the gas-liquid dissolving chamber whereas only a stable and weak water stream can flow into the gas-liquid separating chamber. It is, therefore, possible to efficiently separate the bubbles from the high dissolved oxygen concentration water. One example of the method for preventing large bubbles from flowing out into the gas-liquid separating chamber is to provide a longer gas-liquid dissolving chamber.

On the other hand, the stream is preferably urged by the hole to some extent so as to generate the circulating stream. Therefore, the diameter of the hole (relief hole) and the number of the holes (relief holes) are preferably designed so as to allow for the formation of an urged stream.

EFFECTS OF THE INVENTION

The gas-liquid dissolving apparatus according to the present invention can increase the contact area and the contact opportunity between the gas and the water by the force of the gas-liquid multi-phase fluid ejected from the nozzle in a superimposed manner, and accelerate the dissolution of the gas into the water. It is, therefore, possible to efficiently increase the oxygen concentration of the oxygen-deficient water area. In addition, the gas-liquid dissolving apparatus according to the present invention traps the water stream by the wall of the gas-liquid dissolving chamber, separates fine bubbles in the gas-liquid separating chamber, and continuously takes out only the high dissolved oxygen concentration water. It is, therefore, possible to prevent the bubbles from curling up the bottom materials. The sealed reaction container such as the high pressure tank and the equipment for controlling the internal pressure and the water level of the reaction container are unnecessary. Therefore, the apparatus itself can be simplified, and the gas-liquid dissolving apparatus can be provided at low cost.

The present invention provides a gas-liquid dissolving apparatus that causes the gas-liquid multi-phase fluid ejected from the nozzle to flow along the dome without stagnation, thereby efficiently increasing the contact opportunity between the gas and the water, efficiently increasing the contact area therebetween, and further accelerating the dissolution of the gas into the water. Thus, it is possible to provide the gas-liquid dissolving apparatus that can more efficiently increase the oxygen concentration of the oxygen-deficient water area.

The present invention provides the gas-liquid dissolving apparatus that urges the gas-liquid multi-phase fluid to flow into the gas-liquid dissolving chamber, thereby efficiently dissolving the gas into the water by the simple configuration. Thus, it is possible to provide the gas-liquid dissolving apparatus that can more efficiently increase the oxygen concentration of the oxygen-deficient water area and that can be configured at low cost.

The present invention provides the gas-liquid dissolving apparatus that causes the high dissolved oxygen concentration water to directly flow out from the hole of the gas-liquid dissolving chamber into the gas-liquid separating chamber. This can dispense with the equipment such as a tube for supplying the high dissolved oxygen concentration water into the gas-liquid separating chamber, simplify the apparatus itself, thereby providing the gas-liquid dissolving apparatus that can be configured at a lower cost.

The present invention provides the gas-liquid dissolving apparatus that can prevent the gas-liquid multi-phase fluid ejected from the nozzle from causing an excessive rise in the internal pressure of the gas-liquid dissolving chamber. Thus, it is possible to provide the gas-liquid dissolving apparatus that can lengthen a life of the gas-liquid dissolving chamber and that is low in maintenance cost and repair cost.

The present invention provides the gas-liquid dissolving apparatus that can increase the water pressure and, therefore, dissolve more gas into the water. As compared with the installation of the apparatus on the ground, energy necessary to take in and discharge water can be saved. Thus, it is possible to provide the gas-liquid dissolving apparatus that can efficiently increase the oxygen concentration of the oxygen-deficient water area at low cost.

The present invention provides the gas-liquid dissolving apparatus that can collect lower specific gravity bubbles at the center using the circulating stream, a velocity of which is higher toward the upper portion, and efficiently and effectively separate the bubbles from the water. Thus, it is possible to provide the gas-liquid dissolving apparatus that can stably and continuously generate the high dissolved oxygen concentration water not containing any bubbles.

The present invention provides the gas-liquid dissolving apparatus which includes a configuration that is simplified to allow for the reduction of factors for fault parts and a long-term continuous use of the apparatus. Thus, it is possible to provide the gas-liquid dissolving apparatus which is low in maintenance cost and repair cost.

The gas-liquid dissolving apparatus according to the present invention can increase the contact area and the contact opportunity between the gas and the water by the force of the gas-liquid multi-phase fluid ejected from the nozzle in a superimposed manner, and accelerate the dissolution of the gas into the water. In addition, the gas-liquid dissolving apparatus according to the present invention can separate the gas from the liquid in the gas-liquid dissolving chamber and the gas-liquid separating chamber by stages, thereby continuously taking out only the liquid part. Thus, it is possible to provide the gas-liquid dissolving apparatus that can continuously supply the liquid into which the high concentration gas component is dissolved and which does not contain any bubbles.

The present invention provides the gas-liquid dissolving apparatus that causes the gas-liquid multi-phase fluid ejected from the nozzle to flow along the dome without stagnation. The gas-liquid dissolving apparatus according to the present invention can efficiently increase the contact opportunity between the gas and the water, increase the contact area therebetween, and further accelerate the dissolution of the gas into the water. Thus, it is possible to provide the gas-liquid dissolving apparatus that can stably and continuously supply the liquid into which the high concentration gas component is dissolved and which does not contain any bubbles.

The present invention provides the gas-liquid dissolving apparatus that urges the gas-liquid multi-phase fluid to flow into the gas-liquid dissolving chamber. The gas can be, therefore, more efficiently dissolved into the water by the simple configuration. Thus, it is possible to provide the gas-liquid dissolving apparatus that can stably and continuously supply the liquid into which the high concentration gas component is dissolved and which does not contain any bubbles at low cost.

The present invention provides the gas-liquid dissolving apparatus that causes the gas-liquid multi-phase fluid having the increased dissolved gas component concentration to directly flow out from the relief hole of the gas-liquid dissolving chamber into the gas-liquid separating chamber. This can dispense with the equipment such as a tube for supplying the gas-liquid multi-phase fluid into the gas-liquid separating chamber, and simplify the apparatus itself, thereby providing the gas-liquid dissolving apparatus that can be configured at lower cost.

The present invention provides a gas-liquid dissolving apparatus that can prevent the gas-liquid multi-phase fluid ejected from the nozzle from causing an excessive rise in the internal pressure of the gas-liquid dissolving chamber. Thus, it is possible to provide the gas-liquid dissolving apparatus that can lengthen a life of the gas-liquid dissolving chamber and that is low in maintenance cost and repair cost.

The present invention provides the gas-liquid dissolving apparatus that can collect lower specific gravity bubbles at the center using the circulating stream, a velocity of which is higher toward the upper portion, and efficiently separate the gas from the liquid. Thus, it is possible to provide the gas-liquid dissolving apparatus that can stably and continuously supply the liquid into which the high concentration gas component is dissolved and which does not contain any bubbles.

The present invention provides the gas-liquid dissolving apparatus that simplifies the configuration of the apparatus to allow for the reduction of factors for fault parts and a long-term continuous use of the apparatus. Thus, it is possible to provide the gas-liquid dissolving apparatus which is low in maintenance cost and repair cost.

DESCRIPTION OF SIGNS

| | |
|---|---|
| 1, 21 | Gas-liquid dissolving apparatus |
| 2, 22, 32 | Nozzle |
| 2a | Tip end |
| 2b, 32b | Ejection port |
| 3, 23 | Pump |
| 4, 24 | Oxygen supplying unit |
| 5, 25 | Gas-liquid dissolving chamber |
| 5a | Top plate |
| 5b, 25b | Hole |
| 6, 26 | Gas-liquid separating chamber |
| 6a, 26a | Gas-vent hole |
| 6b, 26b | Water supply port |
| 10 | Fixed portion |
| 11 | Gas-liquid multi-phase fluid |
| 12 | Pumping hose |

-continued

| | |
|---|---|
| 13 | Water supply hose |
| 25a | Ceiling |
| 27 | Partition member |
| 27a | Upper portion |
| 30 | Pedestal |
| 31 | Leg |
| 34 | Air supply tube |

BEST MODE FOR CARRYING OUT THE INVENTION

First Embodiment

Exemplary embodiments of the present invention will be explained hereinafter in detail with reference to the accompanying drawings.

Figure 1:
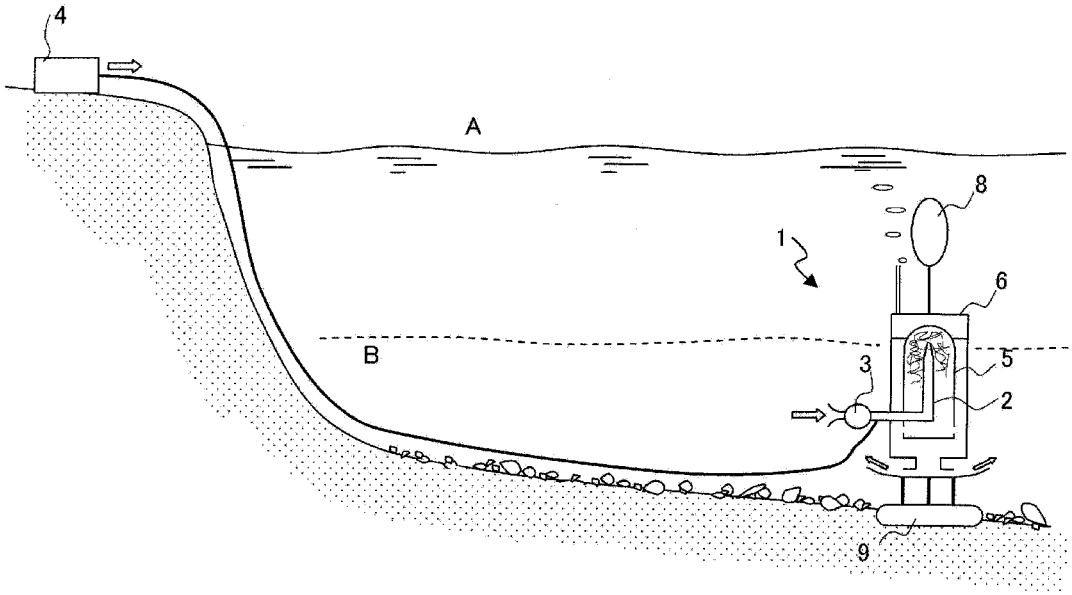
FIG. 1 is an explanatory view of an example of correction of oxygen deficiency of a lake by a gas-liquid dissolving apparatus according to a first embodiment of the present invention.
Figure 2:
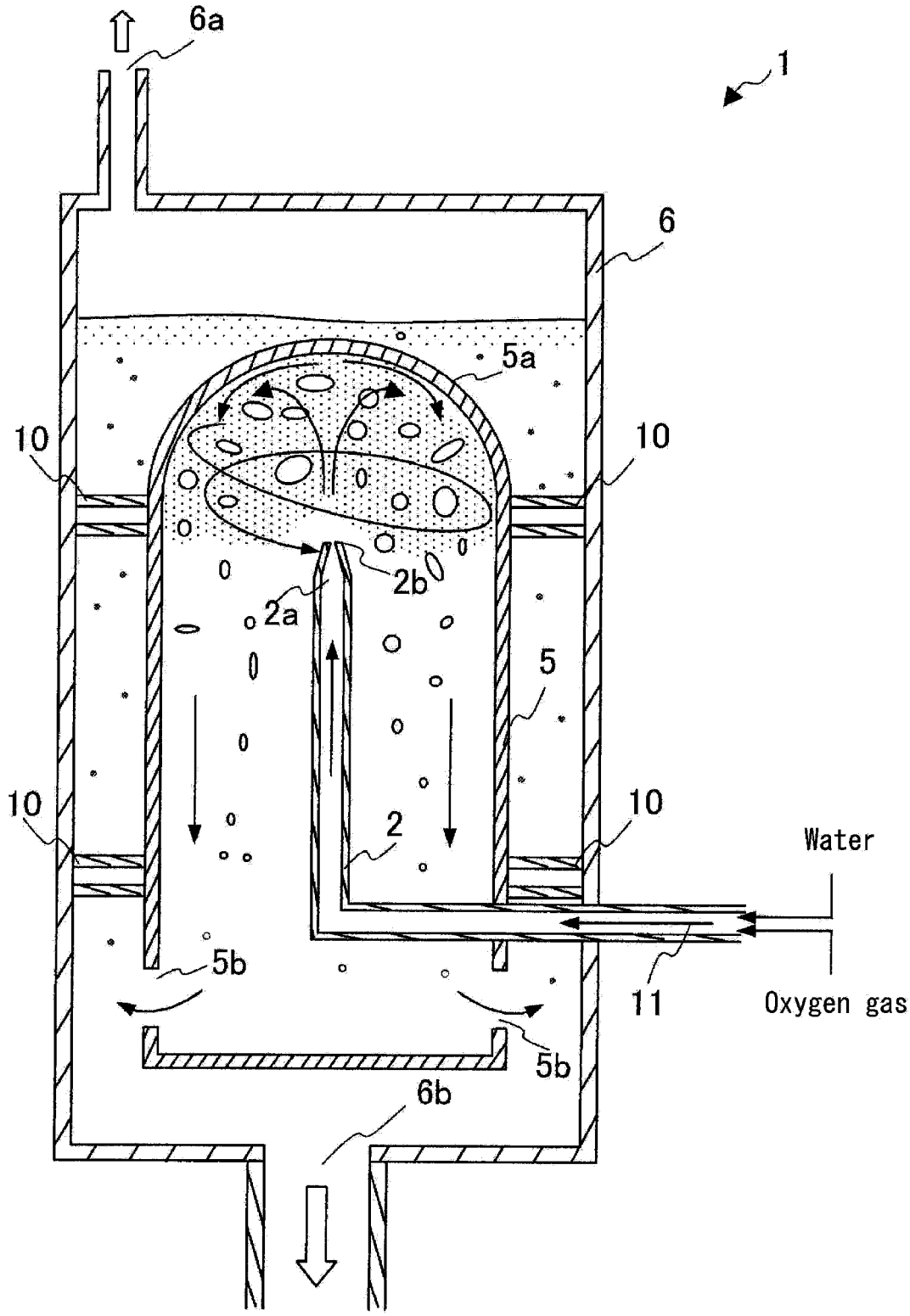
FIG. 2 is a cross-section of an example of a schematic configuration of main parts of the gas-liquid dissolving apparatus according to the first embodiment.
Figure 3:
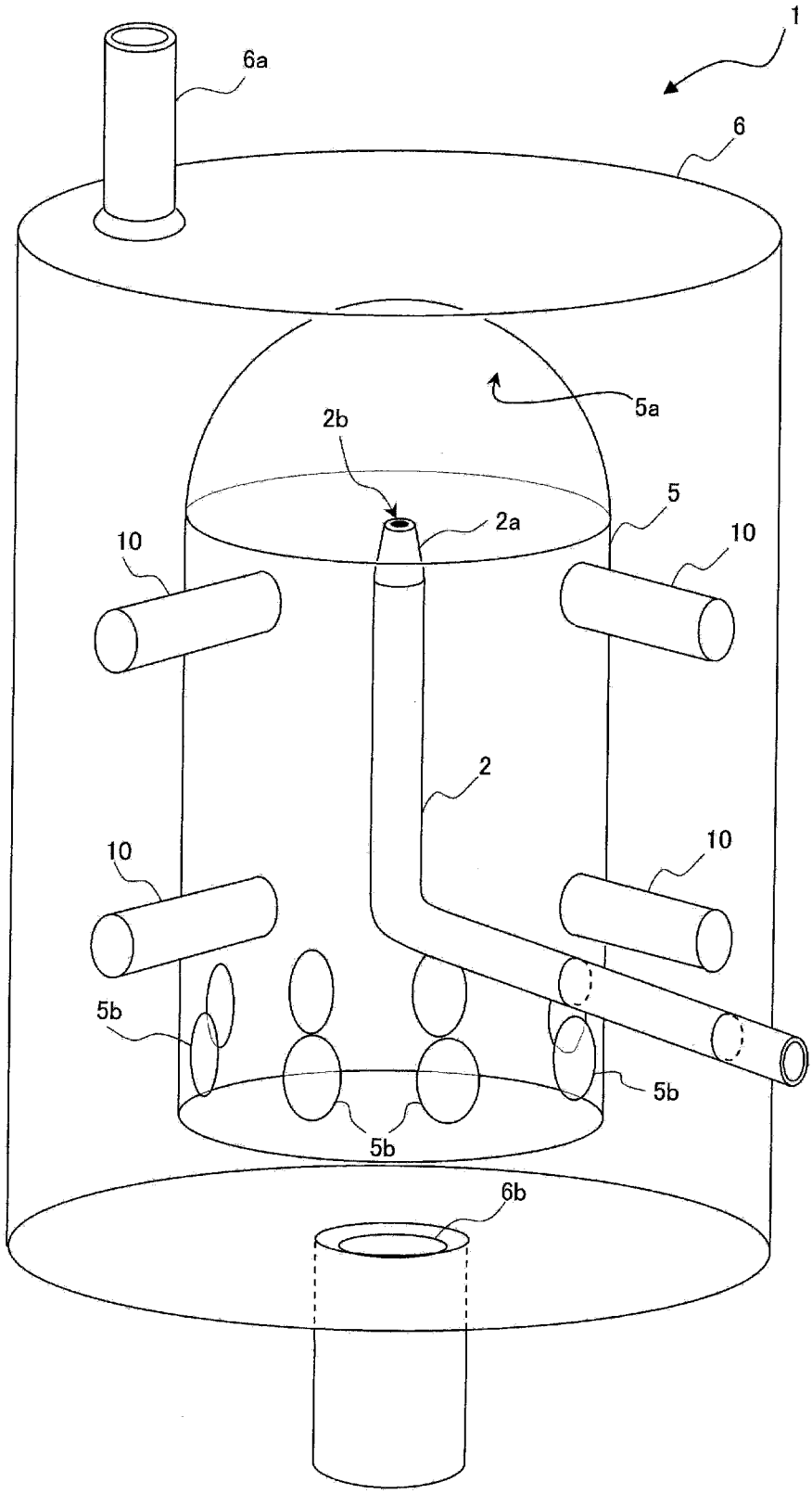
FIG. 3 is an oblique schematic view of the main parts of the gas-liquid dissolving apparatus according to the first embodiment.

FIG. 1 is an explanatory view of an example of correction of oxygen deficiency of a lake by a gas-liquid dissolving apparatus according to the embodiment. FIG. 2 is a cross-section of an example of a schematic configuration of main parts of the gas-liquid dissolving apparatus according to the embodiment. FIG. 3 is an oblique schematic view of the main parts of the gas-liquid dissolving apparatus according to the embodiment. A gas-liquid dissolving apparatus 1 includes a pump 3 that takes in water from an oxygen-deficient water area B of a lake A and that supplies the taken-in water to a nozzle 2, an oxygen supplying unit 4 that supplies oxygen-containing gas (hereinafter, sometimes referred to as "oxygen gas" as appropriate, as which the air can be used) to the nozzle 2, the nozzle 2 that ejects the water supplied by the pump 3 and the oxygen gas supplied by the oxygen supplying unit 4 toward a top plate 5*a* within a gas-liquid dissolving chamber 5, the gas-liquid dissolving chamber 5 that agitates the water and the oxygen gas ejected from the nozzle 2 to generate high dissolved oxygen concentration water, and a gas-liquid separating chamber 6 that stores the high dissolved oxygen concentration water generated within the gas-liquid dissolving chamber 5 and oxygen gas bubbles which are not dissolved into the water while separating them from each other.

As shown in FIG. 1, the gas-liquid dissolving apparatus 1 is installed in the oxygen-deficient water area B. To keep its position, the gas-liquid dissolving apparatus 1 according to the embodiment has a float 8 provided in an upper portion and a weight 9 provided in a lower portion. By thus providing the float 8 and the weight 9, the apparatus 1 can be easily installed only by immersing the apparatus 1 from the surface of the water.

The gas-liquid dissolving chamber 5, which is an elongated bottomed cylindrical member, has the top plate 5*a* of a dome shape and a plurality of holes 5*b* formed in a lower side surface, and is configured to be sealed except for the holes 5*b* and the nozzle 2. Within the gas-liquid dissolving chamber 5, the nozzle 2 formed so that an inside diameter of a tip end 2*a* thereof is smaller toward an ejection port 2*b* is arranged to face a center of the dome shape with the ejection port 2*b* directed upward. The pump 3 and the oxygen supplying unit 4 are connected to the nozzle 2 so that a gas-liquid multi-phase fluid which is a mixture of the oxygen-deficient water and the oxygen gas always flows in at a certain water pressure.

The gas-liquid separating chamber 6, which is an elongated cylindrical member, is configured to entirely cover the gas-liquid dissolving chamber 5 and to hold the gas-liquid dissolving chamber 5 with a fixed portion 10. The gas-liquid separating chamber 6 has a gas-vent hole 6*a* formed in an upper portion so as to discharge or recycle the gas that eventually remains as gas. The gas-liquid separating chamber 6 also has a water supply port 6*b* provided on a bottom so as to return the high dissolved oxygen concentration water to the oxygen-deficient water area B. Though the gas-liquid separating chamber 6 is columnar, a cross-sectional shape of the chamber 6 is not specifically limited and may be a polygonal shape, a circular shape or an elliptic shape. Depending on a usage, the gas-liquid separating chamber 6 may be of an ellipsoidal shape such as an egg-like shape.

A processing operation of the gas-liquid dissolving apparatus 1 will be explained below. The pump 3 is actuated first to take in the water in the oxygen-deficient water area B and to supply the water to the intake nozzle 2. At the same time, the oxygen supplying unit 4 supplies the oxygen gas to the nozzle 2. The water and the oxygen gas thus supplied form a gas-liquid multi-phase fluid 11 within the nozzle 2. The gas-liquid multi-phase fluid 11 is urged by a pump pressure and further urged by the tapered tip end 2*a* of the nozzle 2, so that the fluid 11 is forcibly ejected into the gas-liquid dissolving chamber 5.

The ejected gas-liquid multi-phase fluid strikes against the top plate 5*a* and then descends along the dome shape. At this time, the gas-liquid multi-phase fluid 11 forms an eddy or a turbulent flow by its own ejection force. This complicated flow allows the oxygen gas within the gas-liquid multi-phase fluid 11 to be transformed to extremely fine bubbles, to considerably increase in a contact area, to wildly contact with the water, and to be agitated. Furthermore, the gas-liquid multi-phase fluid 11 descending within the gas-liquid dissolving chamber 5 strikes against the gas-liquid multi-phase fluid 11 ejected from the nozzle 2, thereby causing the further contact and the agitation between the oxygen gas and the water and efficiently dissolving the oxygen gas into the water. In this manner, the high dissolved oxygen concentration water is generated in the gas-liquid dissolving chamber 5.

The high dissolved oxygen concentration water descends within the gas-liquid dissolving chamber 5 together with the oxygen gas bubbles which do not dissolve into the water, and moves to the gas-liquid separating chamber 6 via the holes 5*b*. Since the holes 5*b* are formed in the lower side surface of the gas-liquid dissolving chamber 5, large bubbles remain in the upper portion of the chamber 5 and fine bubbles and the high dissolved oxygen concentration water move to the gas-liquid separating chamber 6. From a different viewpoint, the gas-liquid dissolving chamber 5 traps a violent water stream, rectifies the water stream so that a jet flow does not move to the gas-liquid separating chamber 6, and feeds the fluid so that the fine bubbles are not shaken within the gas-liquid separating chamber 6.

The high dissolved oxygen concentration water and the bubbles are temporarily stored in the gas-liquid separating chamber 6, whereby the bubbles are separated and moved toward the upper portion and only the high dissolved oxygen concentration water without any bubbles is steadily returned to the oxygen-deficient water area B from the water supply port 6*b*. To prevent the bubbles flowing out from the holes 5*b* from mixing into the high dissolved oxygen concentration water supplied from the water supply port 6*b*, the water supply port 6*b* is provided at a position lower than and apart from the holes 5*b*.

First Example

Figure 4:
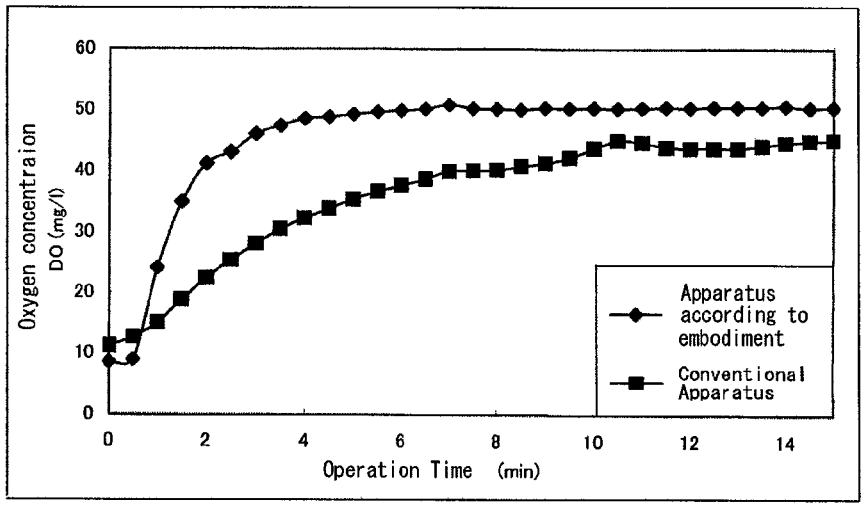
FIG. 4 is a graph that depicts a change in a dissolved oxygen amount of water treated by the gas-liquid dissolving apparatus according to the first embodiment against an apparatus operation time.

The oxygen-deficient water is treated by the gas-liquid dissolving apparatus and a dissolved oxygen concentration of the oxygen-deficient water is measured. FIG. 4 is a graph that depicts a change in the dissolved oxygen concentration of the water treated by the gas-liquid dissolving apparatus explained in the first embodiment against the apparatus operation time. Measurement conditions are as follows. A flow rate of the water ejected from the nozzle is 10 liters/min, a concentration of the supplied oxygen gas is 99.9% (using an oxygen cylinder), a supply amount of the oxygen gas is 0.5 liter/min, an internal pressure of the gas-liquid dissolving chamber is 0.1 megapascal (a pressure equal to approximately one atmospheric pressure), and a water temperature is 27° C. In the graph shown in FIG. 4, the dissolved oxygen concentration of the water treated by the conventional apparatus shown in FIG. 5 is also shown for comparison purposes.

Figure 5:
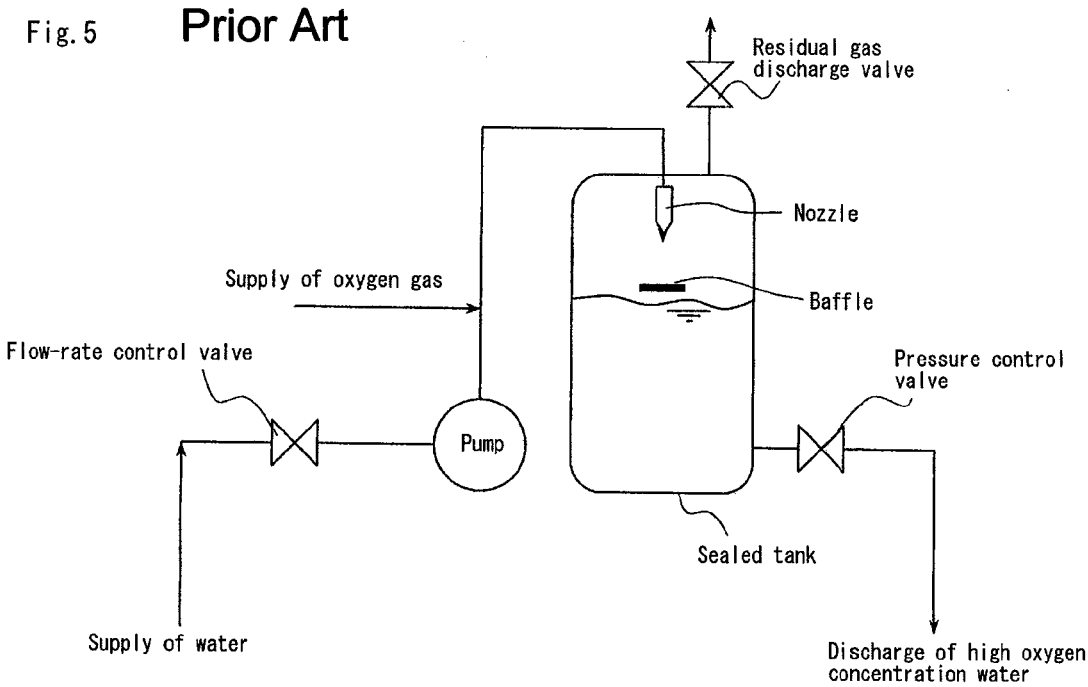
Fig. 5 Prior Art
FIG. 5 is a schematic diagram of a conventional apparatus.

The conventional apparatus shown in FIG. 5 is one of the apparatuses that can supply the high dissolved oxygen concentration water. Briefly, the conventional apparatus includes a sealed tank that serves as a reaction container for a gas-liquid dissolving reaction, a pump that takes in water, a flow control valve that is provided upstream of the pump and that adjusts a supply amount of the water, an oxygen gas supply source, a nozzle that ejects the water and the oxygen gas to the sealed tank, a baffle that causes the gas and the liquid ejected from the nozzle to strike against each other, a valve that discharges residual gas collected in the sealed tank, and a valve that adjusts a discharge amount of the high dissolved oxygen concentration water generated in the sealed tank.

The conventional apparatus fills up the oxygen gas into the sealed tank in advance, adjusts the water level so that the water surface is located below the baffle, ejects the water and the oxygen gas toward the baffle, and dissolves the gas into the water. The conventional apparatus of this type needs a controller (not shown) that controls the internal pressure and the water level of the sealed tank. The valve that discharges the residual gas, in particular, requires complicated control since water level adjusting function is provided, therefore the apparatus itself is unavoidably made large in size and expensive.

As evident from FIG. 4, the gas-liquid dissolving apparatus according to the example enters into a stationary operation approximately four minutes after the start. The apparatus can supply the high dissolved oxygen concentration water having an oxygen concentration of 50 mg/liter. The conventional apparatus shown in FIG. 5, by contrast, enters into a substantially stationary operation approximately eight minutes after the start. However, the concentration of the obtained high dissolved oxygen concentration water is 40 to 45 mg/liter. In addition, since the apparatus exercises a control for discharging the residual gas to adjust the water level, the oxygen concentration is unstable. It can also be confirmed that the supply of the high dissolved oxygen concentration water to the oxygen-deficient water area B is not constant due to the discharge of the residual gas in the conventional apparatus.

If the dissolved oxygen concentration of the high dissolved oxygen concentration water is relatively low, it is necessary to supply a large amount of the high dissolved oxygen concentration water to the oxygen-deficient water area. This often causes turbulence of the bottom materials depending on water stream. In order to prevent the turbulence of the bottom materials and efficiently increase the dissolved oxygen concentration of the oxygen-deficient water area, it is necessary to stably supply higher dissolved oxygen concentration water without fluctuation. As shown in FIG. 4, the gas-liquid dissolving apparatus according to the embodiment can stably and continuously generate the higher dissolved oxygen concentration water than that according to the conventional apparatus. In the example, since it is unnecessary to pump up the water in the oxygen-deficient water area to the ground, energy can be saved.

Figure 6:
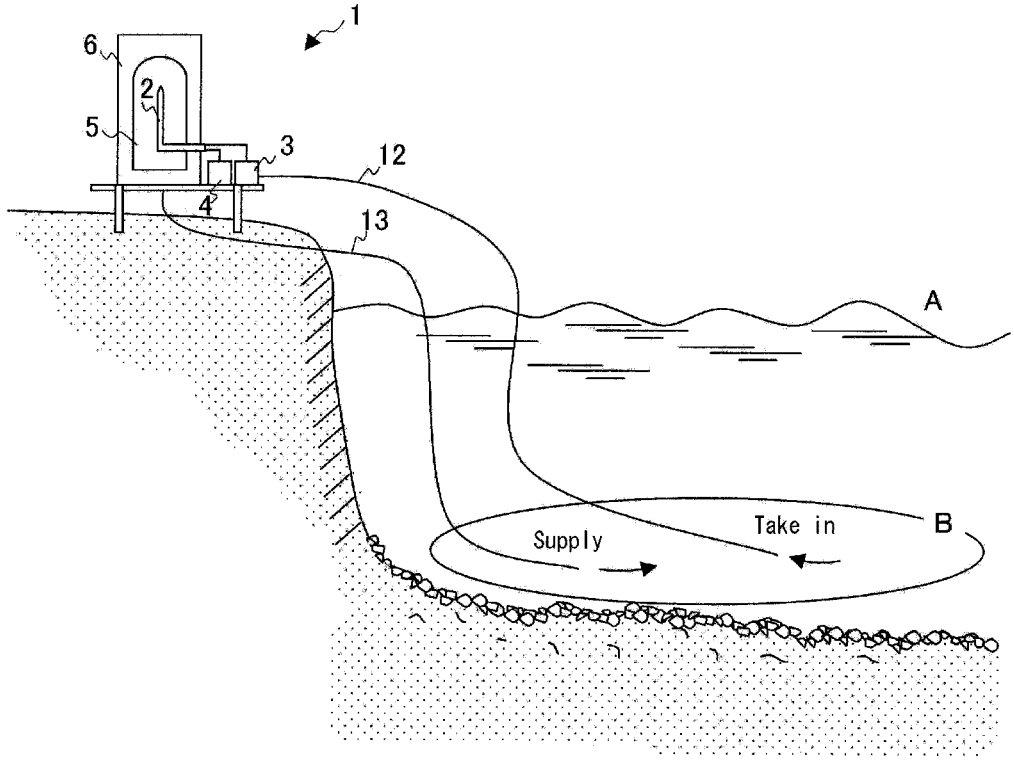
FIG. 6 is an explanatory view of installation of the gas-liquid dissolving apparatus on the ground.

In the first embodiment as well as the example, the gas-liquid dissolving apparatus is installed in the oxygen-deficient water area. However, depending on the usage, the apparatus may be installed on the ground. FIG. 6 is an explanatory view of the installation of the gas-liquid dissolving apparatus on the ground. In FIG. 6, like reference numerals denote like constituent elements as those shown in FIG. 1. In FIG. 6, reference numeral 12 denotes a pumping hose that pumps up the water from the oxygen-deficient water area B, and reference numeral 13 denotes a water supply hose that returns the high dissolved oxygen concentration water from the water supply port 6*b* to the oxygen-deficient water area B. The apparatus is installed on the ground when, for example, a cost is increased if the apparatus is installed in the oxygen-deficient water area B, when much bottom sludge is present in the oxygen-deficient water area B and it is difficult to secure a foothold, and when the apparatus is buried in the bottom sludge and difficult to withdraw.

The underwater installation is compared with the ground installation from viewpoints of the dissolved oxygen concentration. If an installation location is deep in the water, the internal pressure of the gas-liquid dissolving chamber rises to allow for more dissolution of the oxygen gas into the water. The underwater installation is, therefore, preferable. The oxygen supplying unit of the gas-liquid dissolving apparatus installed in the water may be configured to supply oxygen from the ground using an oxygen generator and a compressor or to supply the oxygen with a gas cylinder installed in the water. Furthermore, regardless of the installation location of the apparatus, that is, whether installed in the water or on the ground, a pressurizing unit that ejects the water from the nozzle may be provided at an element other than the pump. Using this pressurizing unit, a pressure may be applied into the gas-liquid dissolving chamber or the gas-liquid separating chamber.

While one nozzle is provided in the embodiment, a plurality of nozzles may be provided depending on the usage. In this case, to prevent the internal pressure of the gas-liquid dissolving chamber from increasing to a level as to break the gas-liquid dissolving chamber, the number of lower holes is appropriately adjusted so that a total area of the holes is larger than a total cross-sectional area of the nozzles. The holes may be formed either in the lower side surface or the bottom of the gas-liquid dissolving chamber as long as the holes do not hamper the separation of the bubbles from the water in the gas-liquid separating chamber.

Second Embodiment

While in the first embodiment, the apparatus obtains the water into which the high concentration "oxygen" is dissolved, the present invention is not limited thereto. When a certain gas component is to be dissolved into a liquid, the same configuration as that of this apparatus can be used. The apparatus for such a purpose includes the supplying unit that supplies a gas-liquid multi-phase fluid in which the liquid and the gas are mixed up, the gas-liquid dissolving chamber that receives a flow of the gas-liquid multi-phase fluid in the upper portion and that has relief holes formed in the lower portion for releasing the fluid, the nozzle that penetrates the gas-liquid dissolving chamber and that ejects the gas-liquid multi-phase fluid supplied by the supplying unit upward toward the upper portion of the gas-liquid dissolving chamber, the gas-liquid separating chamber that is provided outside the gas-liquid dissolving chamber while communicating with the gas-liquid dissolving chamber through the relief holes, that stores the gas-liquid multi-phase fluid from the relief holes, and that separates the liquid from the gas, and the takeout port from which the liquid separated in the gas-liquid separating chamber is taken out. With this configuration, turbulence is produced by the force of the ejection of the fluid from the nozzle and a reflux thereof from the top plate, whereby the concentration of the gas component dissolved into the liquid can be increased.

The takeout port may be provided in the lower portion of the gas-liquid separating chamber similarly to the first embodiment. Alternatively, if the apparatus is installed on the ground, for example, the takeout port may be provided in the upper portion of the gas-liquid separating chamber and formed to be wide so as to appropriately ladle out the fluid.

Third Embodiment

A gas-liquid dissolving apparatus for seawater will next be explained. If the gas-liquid dissolving apparatus according to the first embodiment is driven in a brackish area of the seawater or having a high salt concentration, extremely fine bubbles are produced and a phenomenon that the bubbles and the seawater can be hardly separated from each other within the gas-liquid separating chamber occurs. This is because the bubbles are made extremely fine by salt and a water stream expels buoyancy even if the water stream is gentle. In a third embodiment, an apparatus that separates the bubbles from the seawater using a circulating stream will be explained.

Figure 7:
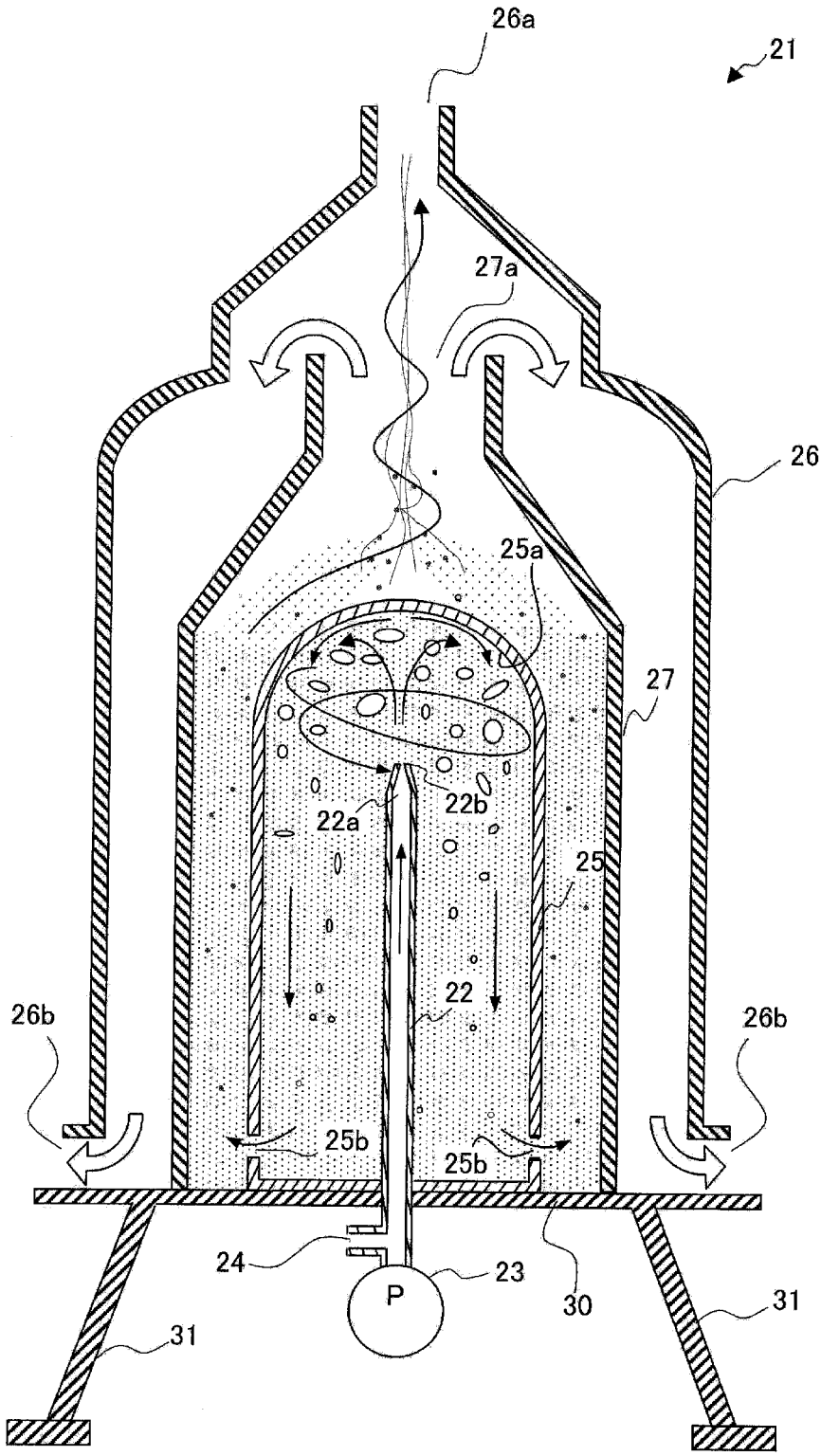
FIG. 7 is a cross-section of an example of a schematic configuration of main parts of a gas-liquid dissolving apparatus according to a third embodiment.
Figure 8:
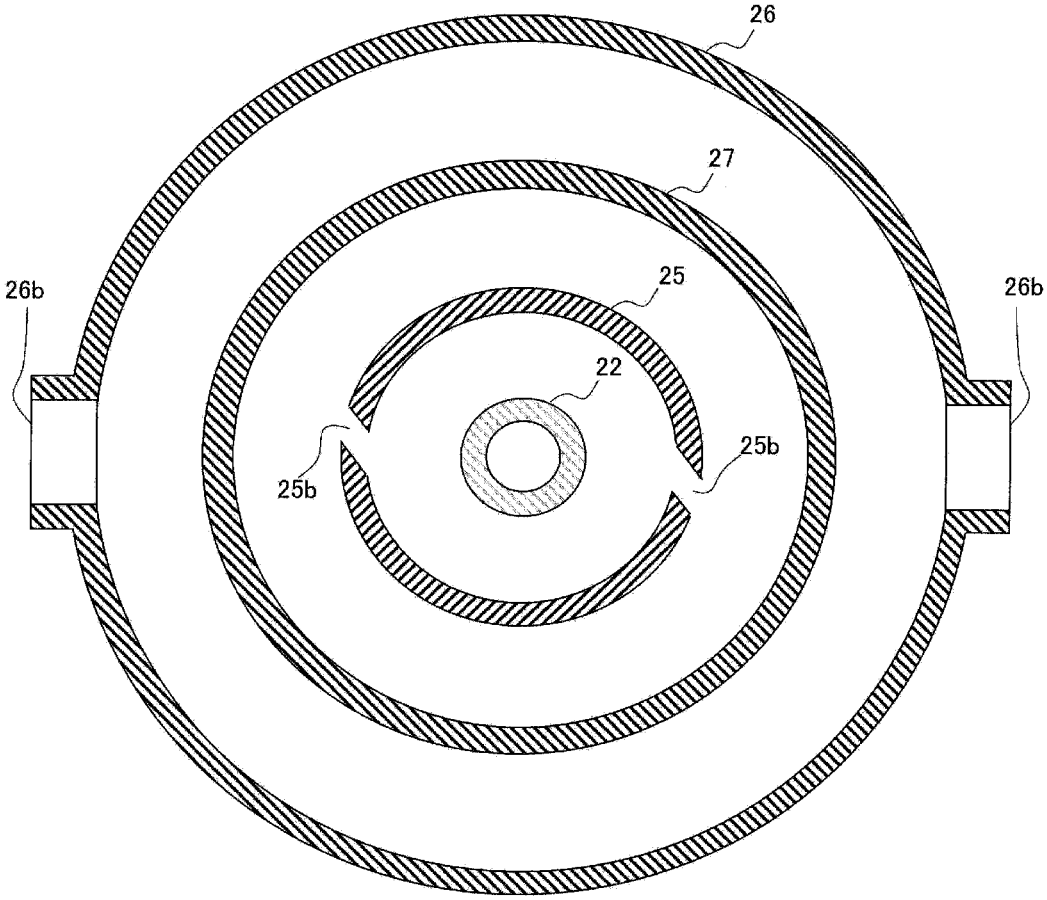
FIG. 8 is a cross-section of a gas-liquid dissolving chamber including holes formed therein according to the third embodiment.

FIG. 7 is a cross-section of an example of a schematic configuration of main parts of the gas-liquid dissolving apparatus according to the embodiment. FIG. 8 is a cross-section of the gas-liquid dissolving chamber including holes formed therein. A gas-liquid dissolving apparatus 21 includes a pump 23 that takes in seawater from an oxygen-deficient water area and that supplies the taken-in seawater to a nozzle 22, an oxygen supply port 24 that supplies an oxygen gas to the nozzle 22, a bottomed gas-liquid dissolving chamber 25 that has holes 25*b* formed in a lower portion and that has a dome-shaped (hemispherical) ceiling 25*a*, the nozzle 22 that ejects the seawater supplied by the pump 23 and the oxygen gas supplied via the oxygen supply port 24 upward so that the seawater and the oxygen gas strike against an inner wall of the ceiling 25*a* from an inside of the gas-liquid dissolving chamber 25, a partition member 27 that covers up the gas-liquid dissolving chamber 25 and that produces a circulating stream between the partition member 27 and an outer wall of the gas-liquid dissolving chamber 25, and a gas-liquid separating chamber 26 that covers up the partition member 27, that has a gas-vent hole 26*a* formed in an upper portion for releasing bubbles to the outside, and that has water supply ports 26*b* provided in a lower portion for supplying the seawater separated from the bubbles.

It is assumed herein that the gas-liquid dissolving apparatus 21 (not shown) is installed in an oxygen-deficient sea area. Examples of such an installation location include an inner bay substantially isolated from the open sea by a breakwater or a narrow water conduit. To keep its position, the gas-liquid dissolving apparatus 21 is provided on a pedestal 30 which is fixed to the bottom of the sea by legs 31.

The gas-liquid dissolving apparatus 21 is characterized by the provision of the partition member 27, which can separate fine bubbles from the seawater. A treatment operation of the apparatus will next be explained. The partition member 27 is bottomed and has an opened upper portion 27*a* and an inner side surface tapered toward the upper portion 27*a*. The gas-liquid dissolving chamber 25 has a hemispherically cylindrical upper portion and a lower portion provided with holes 25*b* so as to obliquely blow out a bubble-seawater multi-phase fluid (see FIG. 8). Due to the arrangement of the holes 25*b*, the multi-phase fluid forms a circulating stream along an outer periphery of the gas-liquid dissolving chamber 25 (an inner periphery of the partition member 27). Since the multi-phase fluid is sequentially supplied from the holes 25*b*, the multi-phase fluid eventually moves helically upward.

Since a diameter of the partition member 27 is narrowed in the upper portion of the apparatus 21, a flow velocity of the multi-phase fluid accelerates. Then, the seawater having a high specific gravity concentrates on the outside and the fine bubbles concentrate on the center and rise by a centrifugal force. A water stream and a gas stream are released in the upper portion 27*a*, the water stream returns to the oxygen-deficient sea area from the water supply port 26*b* by its own weight, and the gas stream is collected by the gas-vent hole 26*a*. Thus, even if the bubbles are formed into fine bubbles, it is possible to generate the higher dissolved oxygen concentration seawater, separate the seawater from the bubbles, and supply the seawater to the oxygen-deficient sea area.

While in the embodiment shown in FIGS. 7 and 8, two holes 25*b* are provided symmetrically, the number of holes 25*b* is not limited to two, and may be three or four. However, to ensure stability of the stream, the holes are preferably provided symmetrically. While in the embodiment, the holes 25*b* are formed obliquely so that the circulating stream can be generated directly by the holes 25*b*, the present invention is not limited to this example. For example, the circulating stream may be generated by the radially formed holes, to which a tube with a bending tip is attached, so that the multi-phase fluid is discharged tangentially.

While in the third embodiment, the entire apparatus is fixed to the bottom of the sea by the legs 31, the present invention is not limited thereto. For example, as shown in the first embodiment, the apparatus may include the float provided in the upper portion and the weight provided in the lower portion so that the apparatus can be installed only by immersing the apparatus from the surface of the water and so that the position of the apparatus in the water can be maintained.

Fourth Embodiment

Figure 9:
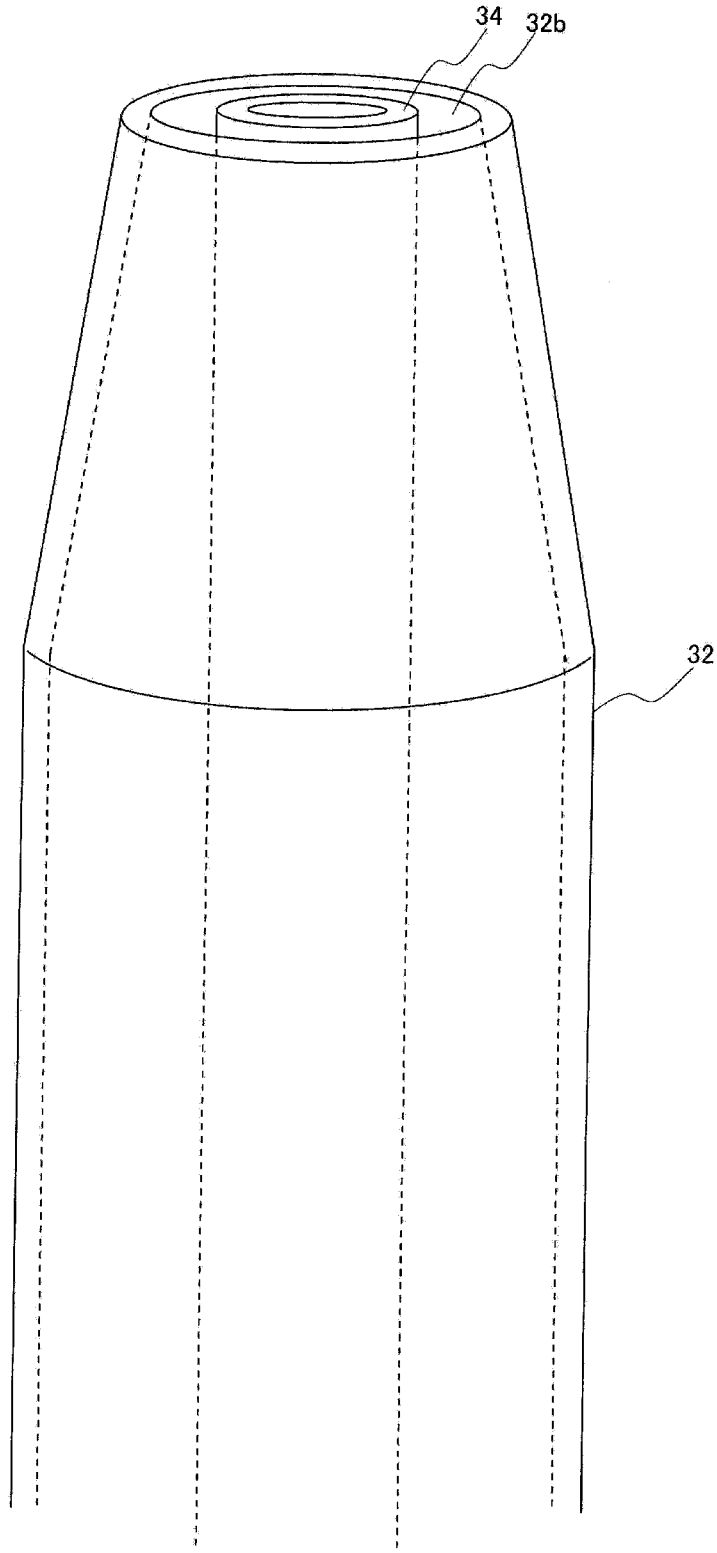
FIG. 9 is an external perspective view of a nozzle of a gas-liquid dissolving apparatus according to a fourth embodiment.

In a fourth embodiment, an apparatus that ejects a gas-liquid multi-phase fluid from a nozzle by natural suction will be explained. FIG. 9 is a perspective view of a tip end of a nozzle of a gas-liquid dissolving apparatus according to the fourth embodiment. In the gas-liquid dissolving apparatus according to the embodiment, an air supply tube 34 penetrates through a nozzle 32 up to a position of the same surface as that on which an ejection port 32*b* is provided. The nozzle 32 is formed to be tapered toward the ejection port 32*b*, so that the water is urged and ejected from the nozzle 32. At this time, a pressure difference is generated, the air is sucked in from the air supply tube 34, and the fluid ejected from the nozzle 32 eventually serves as the gas-liquid multi-phase fluid.

With the above configuration, it is unnecessary to supply the air by the pump and the air can be supplied simply with an extension of the other end of the air supply tube 34 above the surface of the water. Since the atmospheric pressure is utilized, an installation depth of the gas-liquid dissolving apparatus is restricted. However, the gas-liquid dissolving apparatus according to the embodiment can be used in a water tank for transporting live fish or the like.

As constituent elements other than the nozzle, those explained in the preceding embodiments can be employed.

INDUSTRIAL APPLICABILITY

With the present invention, qualities of water of brackish lakes, dam lakes, or closed sea areas (sea areas with little flow-in or flow-out of the seawater) can be improved.

The invention claimed is:

1. A gas-liquid dissolving apparatus that dissolves an oxygen-containing gas into water taken in from an oxygen-deficient water area, increases a dissolved oxygen concentration of the water, and returns the increased dissolved oxygen concentration water to the oxygen-deficient water area, the apparatus comprising:

an intake unit that takes in to-be-treated water from the oxygen-deficient water area;

a supplying unit that supplies the oxygen-containing gas;

a bottomed gas-liquid dissolving chamber that has at least one hole formed in a lower portion and that has a top plate provided in an upper portion;

a nozzle that ejects the gas supplied by the supplying unit and the water supplied by the intake unit upward so that the gas and the water strike against an inner wall of the top plate, that fills the gas-liquid dissolving chamber with bubbles of the gas and the water, and that vigorously agitates the bubbles and the water by forces of the ejected gas and water;

a gas-liquid separating chamber that is provided outside the gas-liquid dissolving chamber while communicating with the gas-liquid dissolving chamber through the holes, that separates the bubbles and the water flowing out from the gas-liquid dissolving chamber through the holes from each other while storing the bubbles and the water, that has a gas-vent hole formed in an upper portion of the gas-liquid separating chamber for releasing the separated bubbles to an outside, and that has a takeout port provided in a lower portion thereof for taking out the water separated from the bubbles; and a water supplying unit that returns the water taken out from the takeout port to the oxygen-deficient water area.

2. The gas-liquid dissolving apparatus according to claim 1, wherein the top plate has a dome shape.

3. The gas-liquid dissolving apparatus according to claim 1, wherein a tip end of the nozzle is tapered toward an ejection port.

4. The gas-liquid dissolving apparatus according to claim 1, wherein the gas-liquid dissolving chamber is accommodated in the gas-liquid separating chamber.

5. The gas-liquid dissolving apparatus according to claim 1, wherein a total sectional area of the hole is set larger than an area of the ejection port of the nozzle.

6. The gas-liquid dissolving apparatus according to claim 1, wherein at least the intake unit, the gas-liquid dissolving chamber, the nozzle, and the gas-liquid separating chamber are installed in the oxygen-deficient water area.

7. The gas-liquid dissolving apparatus according to claim 1, wherein a side surface of the gas-liquid dissolving chamber is formed to be cylindrical or axially symmetric, and the gas-liquid dissolving chamber is accommodated in the gas-liquid separating chamber, a partition member that has an open upper portion and a side surface of a cylindrical or axially symmetric shape, and that is formed to be tapered toward the upper portion is provided between the gas-liquid dissolving chamber and the gas-liquid separating chamber, the bubbles and the water moving from the gas-liquid dissolving chamber toward the partition member through the hole are caused to flow out at a predetermined angle with respect to a radial direction of the gas-liquid dissolving chamber, and a circulating stream that moves upward is generated between an outside of the gas-liquid dissolving chamber and an inside of the partition member.

8. The gas-liquid dissolving apparatus according to claim 7, wherein a formation direction of the hole is set to a direction at the predetermined angle by a thickness of the gas-liquid dissolving chamber.

9. A gas-liquid dissolving apparatus comprising:

a supplying unit that supplies a gas-liquid multi-phase fluid in which a liquid and a gas are mixed up;

a gas-liquid dissolving chamber that receives a flow of the gas-liquid multi-phase fluid in an upper portion and that has a relief hole formed in a lower portion for releasing fluid;

a nozzle that penetrates the gas-liquid dissolving chamber and that ejects the gas-liquid multi-phase fluid supplied by the supplying unit upward toward the upper portion of the gas-liquid dissolving chamber;

a gas-liquid separating chamber that is provided outside the gas-liquid dissolving chamber while communicating with the gas-liquid dissolving chamber through the relief hole, that stores the gas-liquid multi-phase fluid from the relief hole, and that separates the liquid from the gas; and a takeout port from which the liquid separated in the gas-liquid separating chamber is taken out, wherein a dissolved gas component concentration of the liquid is increased by agitation caused by a force of ejection from the nozzle and a reflux from the upper portion of the gas-liquid dissolving chamber.

10. The gas-liquid dissolving apparatus according to claim 9, wherein the upper portion of the gas-liquid dissolving chamber has a dome shape.

11. The gas-liquid dissolving apparatus according to claim 9, wherein a tip end of the nozzle is tapered toward an ejection port.

12. The gas-liquid dissolving apparatus according to claim 9, wherein the gas-liquid dissolving chamber is accommodated in the gas-liquid separating chamber.

13. The gas-liquid dissolving apparatus according to claim 9, wherein a total sectional area of the relief hole is set larger than an area of the ejection port of the nozzle.

14. The gas-liquid dissolving apparatus according to claim 9, wherein a side surface of the gas-liquid dissolving chamber is formed to be cylindrical or axially symmetric, and the gas-liquid dissolving chamber is accommodated in the gas-liquid separating chamber, a partition member that has an open upper portion and a side surface of a cylindrical or axially symmetric shape, and that is formed to be tapered toward the upper portion is provided between the gas-liquid dissolving chamber and the gas-liquid separating chamber, the gas-liquid multi-phase fluid moving from the gas-liquid dissolving chamber toward the partition member through the relief hole is caused to flow out at a predetermined angle with respect to a radial direction of the gas-liquid dissolving chamber, and a circulating stream that moves upward is generated between an outside of the gas-liquid dissolving chamber and an inside of the partition member.

15. The gas-liquid dissolving apparatus according to claim 14, wherein a formation direction of the hole is set to a direction at a predetermined angle with respect to a radial direction of the gas-liquid dissolving chamber by a thickness of the gas-liquid dissolving chamber.

* * * * *